US007383801B1

(12) United States Patent
Siepmann et al.

(10) Patent No.: US 7,383,801 B1
(45) Date of Patent: Jun. 10, 2008

(54) VALVE GEAR FOR LOAD CHANGE VALVES OF INTERNAL COMBUSTION ENGINES

(75) Inventors: Walter Siepmann, Chemnitz (DE); Jörg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 0 days.

(21) Appl. No.: 11/649,384

(22) Filed: Jan. 3, 2007

(30) Foreign Application Priority Data

Jan. 23, 2006 (DE) ..... 10 2006 003 002

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39
See application file for complete search history.

(56) References Cited

U.S. PATENT DOCUMENTS 5,119,773 A 6/1992 Schön et al.
5,588,411 A 12/1996 Kreuter et al.
5,666,913 A 9/1997 Gustafson et al.
6,550,435 B1 4/2003 Zubeck
7,137,368 B2 * 11/2006 Schon et al. ..... 123/90.16

FOREIGN PATENT DOCUMENTS

DE 38 33 540 4/1990
DE 195 01 386 8/1996

* cited by examiner

*Primary Examiner*—Zelalem Eshete
(74) *Attorney, Agent, or Firm*—Collard & Roe, P.C.

(57) ABSTRACT

A valve gear arrangement for load change valves of internal combustion engines has an intermediate element that is pivoted on a lever in the cylinder head, to activate the load change valves. The intermediate element engages a cam of a camshaft and has fork-shaped parallel guides on guide cylinders, over the center axis of which a guide groove in the shape of a circular ring segment extends. A roller axle of a roller that engages the cam is displaceably guided in the guide groove. There are springs supported on the roller axle that force the roller axle against an adjustable guide element, counter to the acting forces, when it passes through a plateau region of the cam, and lies against the plateau region.

4 Claims, 5 Drawing Sheets

3
52
D53
53
12
D12
DR
2
51
B
4
E max.
50
Ro
Ri
42
2

3
ZK
30
31
6
ZK
50E
ZK
1
51
11
P
ΦP
5
F
4
41
ZK

E max.
5
3
2
52
53
50
11
DR
4
$E_A$
$\alpha_0$
$\alpha_1$
$\alpha_2$
P
e

E max.
$\Phi_{w\,min}P$
$P_A$
$P_E$
$\Phi P$
B max
DR
F
52
53
2
3
4
5
6
$\alpha_0$
$\alpha_3$
$\alpha_4$
$\alpha_5$

VALVE GEAR FOR LOAD CHANGE VALVES OF INTERNAL COMBUSTION ENGINES

BACKGROUND OF THE INVENTION

1. Field of the Invention

The invention relates to a valve gear for load change valves of internal combustion engines, that are held in the closed position by spring force. An intermediate element is articulated onto a lever mounted in a fixed position in the cylinder head, so as to pivot, in order to activate the load change valves. This intermediate element rests against an adjustable counter-bearing and engages a cam of a camshaft mounted in the cylinder head.

2. The Prior Art

Valve gears of this type are shown in FIG. 1 of German Patent No. DE 38 33 540 C2. A load change valve held in the closed position by spring force is indirectly activated by a cam, via a pivot lever mounted in a fixed location, by way of an intermediate element articulated onto the pivot lever, in accordance with the cycle, but with variably adjustable opening characteristics.

The cam, with its control curve, forces the triangle-shaped intermediate lever articulated onto the pivot lever against a roller that is fixed in place, but is adjustable by pivoting in its position. The pivoting for changing the roller position takes place about the imaginary articulation axle of the intermediate element on the pivot lever, specifically in the position that the articulation axle assumes when the valve is closed.

Depending on the position of the roller, the control curve converts the movement transferred by the cam into different valve opening curves, all the way to non-opening of the valve, by the articulation on the pivot lever.

With the valve gear embodiment described above, it is disadvantageous that only a slight valve stroke is performed when the opening time is short, due to the kinematics.

SUMMARY OF THE INVENTION

It is therefore an object of the invention to configure a valve gear where the full valve stroke is effective even in the case of slight opening, and the opening angle is reduced in the case of full or approximately full valve stroke.

According to the invention, this is achieved by means of a combination of the following characteristics:

the cam has a known plateau region for maximal valve lift that follows the lift phase, the lever for activating the load change valves is configured as a rocker arm, onto which the intermediate element is articulated so as to pivot, the intermediate element has a fork-shaped parallel guide that engages a guide cylinder of the camshaft, over the center axis of which a guide groove in the shape of a circular ring segment extends, in which a roller axle of a roller that engages the cam is guided in a displaceable manner, the inner and the outer delimitations of the guide groove describe arcs or curves that approximate the ring segment, which are configured centrally or with a slight deviation from the centered progression, relative to the plateau region, when the roller engages on the plateau region of the cam, in the position of the intermediate element in the case of maximal lift of the valve(s), the guide groove extends, starting from the plane of engagement of the roller on the cam, approximately at the same or a smaller angle than the plateau region of the cam opposite the direction of rotation of the camshaft, a spring is supported on the roller axle of the roller that engages the cam, and forces the roller axle against a control curve of a guide element that is directed in the direction of rotation of the cam, counter to the forces that will be considered below, when it passes through the plateau region, and lies against it, and the control curve is guided so that the guide groove is more or less covered by the cam, depending on its position, proceeding from the plane of lifting of the roller.

With the invention, the load will flow evenly when the valve(s) is/are fully open, even with short opening times, and an intentional load movement in the cylinder space can be effectively initiated in this manner.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figures 1, 2:
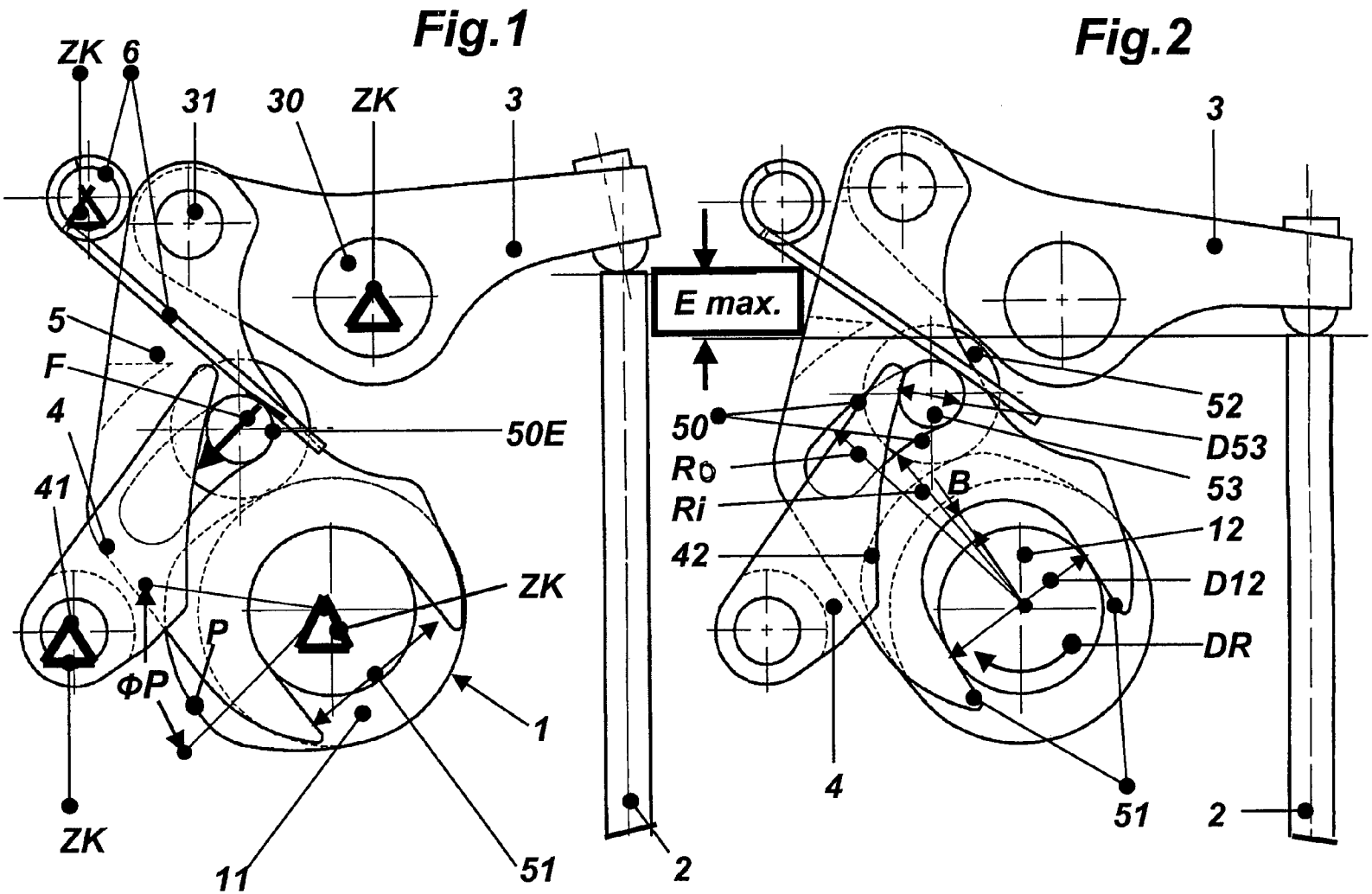
FIGS. 1 and 2 and 4 to 9 show the valve gear according to the invention in two different settings, with a maximal and minimal opening duration of the valve, with reference to the cam angle of rotation, and with different settings of the cam 11 and the camshaft 1.

The structure of the valve gear according to the invention will be explained using FIGS. 1 and 2. A load change valve, which is forced into or held in the closed position by spring force (not shown), is activated in a usual manner, indirectly, by a cam 11 of a camshaft 1 mounted in the cylinder head ZK. This activation occurs via an intermediate element 5 and a rocker arm 3 that is mounted in a fixed position in cylinder head ZK, so as to pivot. Because the axis of camshaft 1 is disposed below rocker arm 3, in the region between axle 30 of rocker arm 3 and articulation axle 31, a compact structure is obtained for the valve gear according to the invention.

Cam 11, following the lift phase, has a known plateau region P for maximal valve lift. Subsequently, a lowering phase follows, which leads back to the cam base circle.

Intermediate element 5 is coupled onto the rocker arm end of rocker arm 3 that lies opposite load change valve 2, by way of an articulation axle 31. It has a fork-shaped parallel guide 51 that engages a guide cylinder 12 of camshaft 1. Over the center axis of camshaft 1, a recess in the shape of a circular ring segment extends as a guide track 50, in which a roller axle 53 of a roller 52 that engages cam 11 is guided in displaceable manner. The inner radius $R_i$ and the outer radius $R_o$ of the guide track 50 in the shape of a circular ring segment describe arcs that run central to the camshaft axis when roller 52 engages on plateau region P of cam 11.

Alternatively, the radii describe curves that approximate such arcs, which are configured to deviate slightly from the central progression to the plateau region P, when roller 52 engages on plateau region P of cam 11. A slight deviation of the curves that approximate the arcs Ri and Ro might be necessary and is advantageous for lifting roller 52 from the base circle or lowering it to the base circle, respectively, in the case of shortened opening angles for the load change valve(s) 2. In this regard, see the explanations relating to FIGS. 4 and 9, in which roller 52 is set onto the base circle and lifted from it, respectively, in a different position than in FIG. 1.

In setting intermediate element 5 for maximal lift $E_{max}$ of load change valve 2, guide track 50 in the shape of a circular ring segment extends, proceeding from the plane of engagement of roller 52 on cam 11, approximately at the same or a smaller angle than plateau region P of cam 11, opposite the direction of rotation DR of camshaft 1.

A spring 6 configured as a wound bending spring is supported on roller axle 53 of roller 52 that engages cam 11, preferably on both sides, with one of its spring arms. The force F that is thereby exerted symmetrically on roller axle 53 is able to force roller axle 53 against a control curve 42 of a guide element 4, and lay roller axle 53 against control curve 42, counter to the forces that act during passage of the base circle.

Springs 6 are disposed in guided manner in cylinder head ZK, whereby one of the spring arms is also counter-mounted there. See FIG. 3, where one of the two springs 6 can be seen there.

Guide element 4 with control curve 42 can pivot about an axle 41 that is mounted in cylinder head ZK, in a fixed location, and can be adjusted into different positions.

Control curve 42 is structured so that it constantly holds roller axle 53 in end contour 50E of guide track 50 in the shape of a circular ring segment of intermediate element 5, in the right end position of guide element 4. In this way, opening of load change valve 2 is set at max. time cross-section Omax.

Control curve 42 covers guide track 50 more or less, depending on the position of guide element 4, and forms a counter-bearing surface in different positions, against which roller axle 53 of roller 52 is forced and laid down, with its outside diameter D53, by force F of springs 6.

When roller 52 engages on plateau region P of cam 11, springs 6 have a greater bias, because of displacement of intermediate element 5 that has occurred, than in the case of engagement on the base circle, so that force F of springs 6 forces roller axle 53 against control curve 42 of guide element 4 and lays it down there, both counter to forces of roller friction that are in effect between roller 52 and cam 11, and counter to other friction and mass inertia forces.

Figure 3:
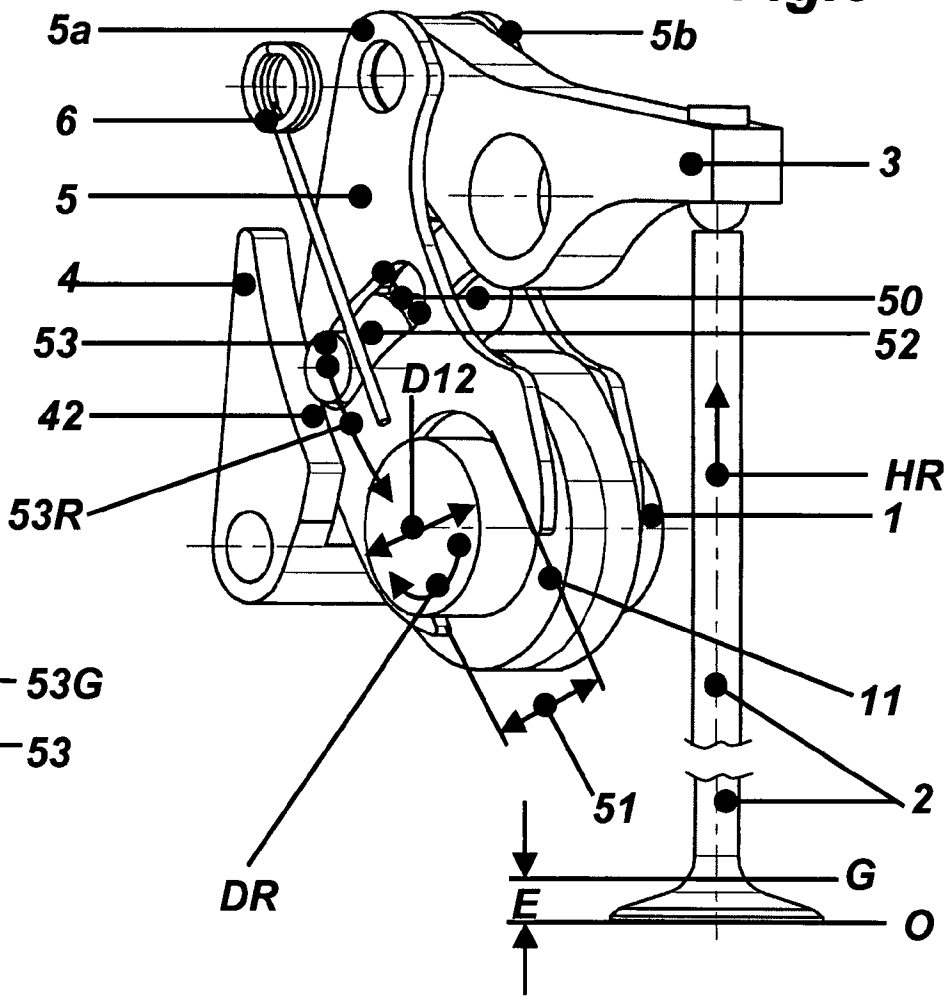
In FIG. 3, a valve gear according to the invention is shown with its interacting elements, in a perspective view, but schematically, without the mountings in the cylinder head.

FIG. 3 shows a perspective view of the interacting elements of the valve gear according to the invention, without its fixed and movable axles. Cam 11 of camshaft 1 is surrounded by intermediate element 5 that is formed by two axially connected guide supports 5*a* and 5*b* that run parallel. Roller 52 constantly engages intermediate element 5 with force fit. Roller axle 53 of roller 52 is constantly forced counter to the direction of rotation DR of cam 11 in guide tracks 50 of intermediate element 5, on both sides, by means of spring 6, and is laid against control curve 42 of guide element 4, which is fixed in place and can pivot, during passage of plateau region P of cam 11. This placement of guide element 4 is advantageous because guide elements 4 of adjacent cylinders can be adjusted jointly by way of one axle.

It would also be possible for control cam 42 to be disposed on a guide element 4 that is guided in the cylinder head with a pushing movement, and adjustable.

The rocker arm 3 that activates load change valve 2 is coupled with intermediate element 5 by way of an axle, not shown, which is mounted in intermediate element 5 in guide supports 5*a* and 5*b* on both sides. The fork-shaped parallel guides 51 that engage diameter D12 of guide cylinders 12 of camshaft 1 are also disposed in guide supports 5*a* and 5*b* of intermediate element 5, on both sides.

In the representation in FIG. 3, load change valve 2 has been brought from its closed position G into an open position O, by means of a displacement E.

Function:

In FIGS. 1 and 2, a constant setting of guide element 4 is shown, in which the maximal time cross-section for opening of load change valve 2 is achieved.

In accordance with the position of control curve 42, roller axle 53 is constantly held in right end contour 50E of guide track 50. Roller 52 should therefore be considered to be fixed in place on intermediate element 5, so that the stroke of cam 11 is transferred to intermediate element 5 by way of roller 52, in accordance with the lift contour, to rocker arm 3 and load change valve 2 by way of articulation axle 31. During the stroke, intermediate element 5 is displaced, guided both by the articulation on rocker arm 3, by way of articulation axle 31, and by parallel guide 51 that engages on guide cylinder 12 of camshaft 1. In this connection, a maximal displacement $B_{max}$ of parallel guide 51 relative to camshaft 1 occurs at maximal valve lift $E_{max}$, as shown in FIG. 2. This maximal valve lift $E_{max}$ is maintained during passage of plateau region P of cam 11 on roller 52, because control curve 42 constantly holds roller axle 53 in the end contour 50E of guide groove 50.

FIGS. 4 to 9 show the movement progression of the individual parts of the valve gear according to the invention during opening of valve 2 with a greatly reduced time cross-section, with the same position of control curve 42, in each instance, but with a changed position as compared with FIGS. 1 and 2.

The force F of spring 6 acts in the same manner as explained with regard to FIGS. 1 and 2, but for the sake of clarity, it is not shown in all of the Figures explained. The arc arrows to the individual rotation positions an describe the angle of rotation of cam 11, in each instance, proceeding from the position $\alpha_0$ of cam 11 in FIG. 4 at the start of engagement of the lift region on cam 11 with roller 52. During engagement of the base circle of cam 11 with roller 52, its roller axle 53 lies against control curve 42 of guide element 4, as shown in FIG. 4, because of the force F of the wound bending spring 6.

In the following, the movement progression and the function of the individual parts will be explained using FIGS. 4 to 9.

Figures 4, 5, 6:
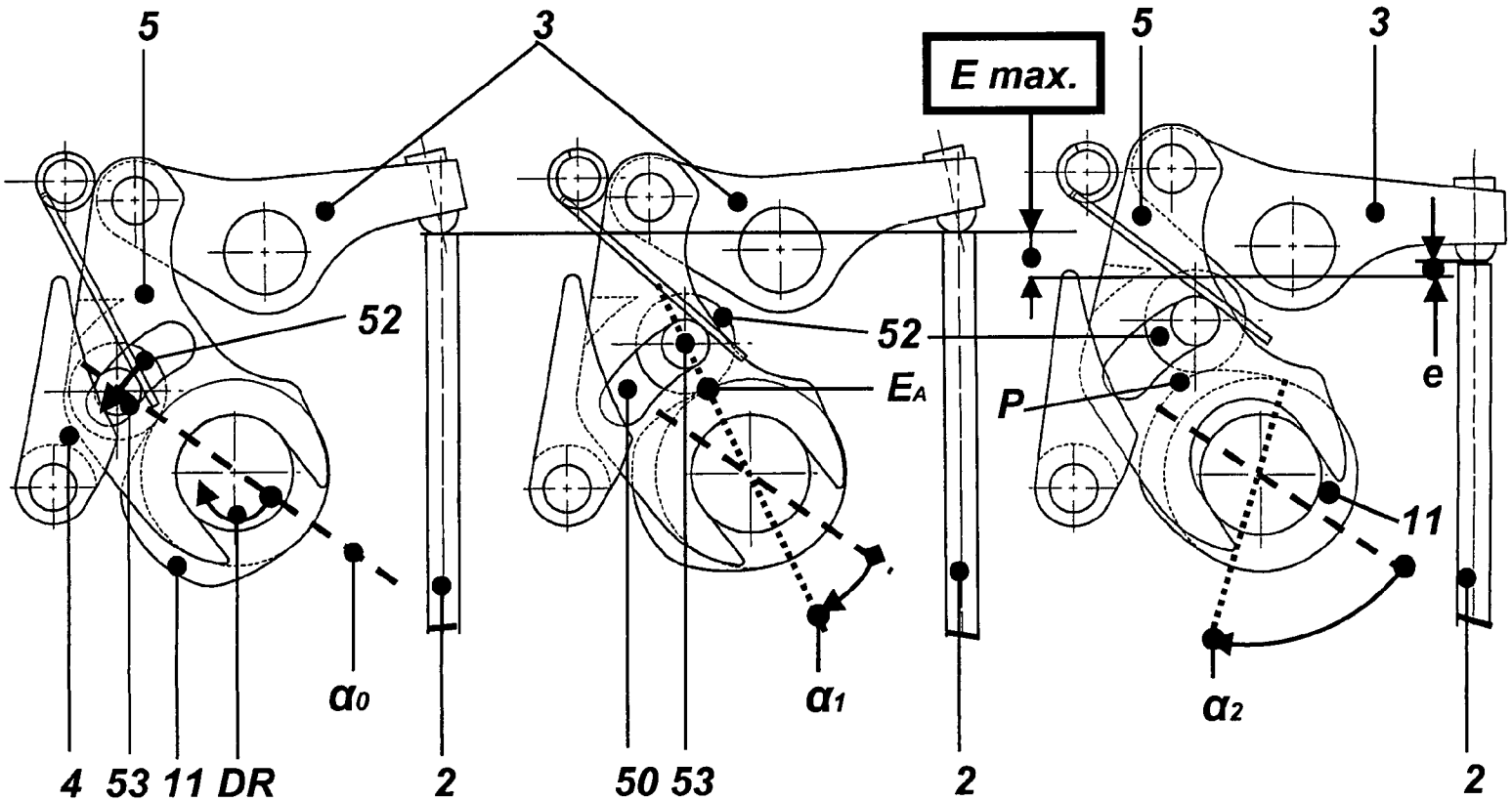

FIG. 4 shows the start of engagement of the lift region of cam 11 in the position $\alpha_0$ of cam 11. Displacement of the roller 52 by the lift contour of cam 11, and thereby of roller axle 53 in guide groove 50, counter to the spring force F, in the direction of rotation DR of camshaft 1 takes place.

FIG. 5 shows that when the position $\alpha_1$ of cam 11 has been reached, roller axle 53 comes to rest in end contour 50E of guide groove 50, whereby the lift region on cam 11 becomes active on roller 52, starting the stroke, which lasts until the plateau region P has been reached.

FIG. 6 shows a position 2 of cam 11 directly before plateau region P has been reached. A path e until the end of the stroke and reaching the maximal valve lift $E_{max}$ during engagement of plateau region P and roller 52 is still lacking.

Figures 7, 8, 9:
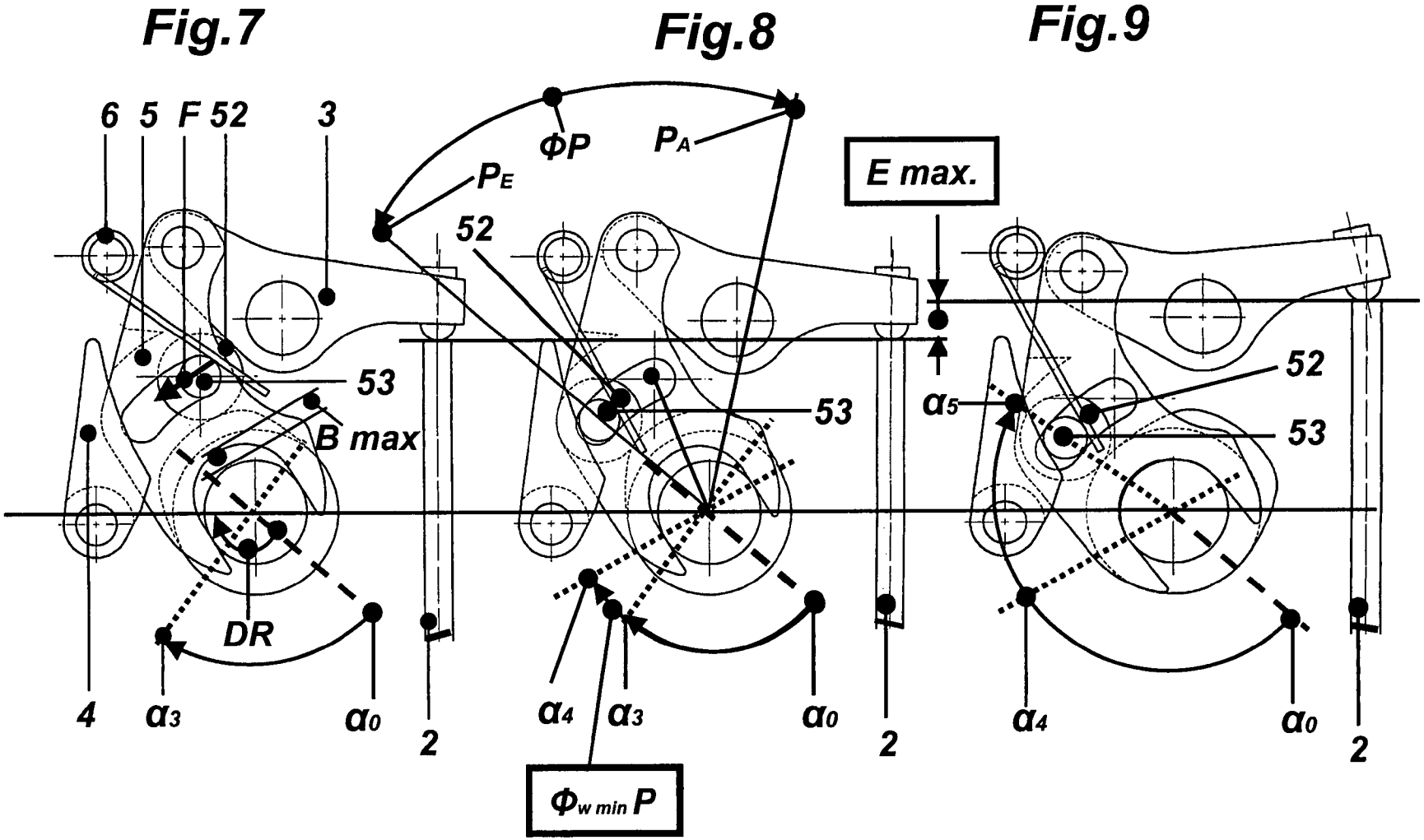

FIG. 7 shows a position $\alpha_3$ of cam 11 when plateau region P is effective. Valve 2 is completely open, see $E_{max}$, and at the same time, the maximal displacement $B_{max}$ of parallel guide 51 relative to camshaft 1 occurs.

Spring force F of springs 6 has a greater bias than in the case of engagement on the base circle of cam 11, because of the displacement of intermediate element 5 that has occurred, see FIG. 4, so that roller axle 53, and with it roller 52, begins to move in the direction of control cam 42 of guide element 4, counter to all the forces that are in effect, and finally roller axle 53 rests against it. In this connection, roller 52 moves on plateau region P of cam 11, counter to the direction of rotation DR of camshaft 1. A reduction in the opening angle for valve 2 occurs. See in this regard FIG. 10, plane b, which shows the lift of valve 2 with cam 11 partially active, according to the invention.

FIG. 8 shows, in the position 4 of cam 11, that roller axle 53 has been laid against control curve 42 of guide element 4, by means of force F of wound bending spring 6, during engagement of plateau region P and roller 52. In this connection, roller 52 was displaced counter to the direction of rotation DR while cam 11 was rotating.

Therefore, only a part $\Phi_{wmin}P$ of the extension angle ΦP of plateau region P becomes effective for full opening of valve 2. Proceeding from the position of roller axle 53 shown, lowering of intermediate element 5 takes place with constant contact between roller axle 53 and control curve 42, determined by the engagement of roller 52 on the lowering region of cam 11. Valve 2 increasingly closes.

FIG. 9 shows the end of the engagement of the lift region of cam 11 in the position $\alpha_5$ of cam 11. The position of roller 52 that stands in engagement with the base circle of cam 11 is determined by the force-fit contact of roller axle 53 on control curve 42, and corresponds to that of FIG. 4.

Figure 10:
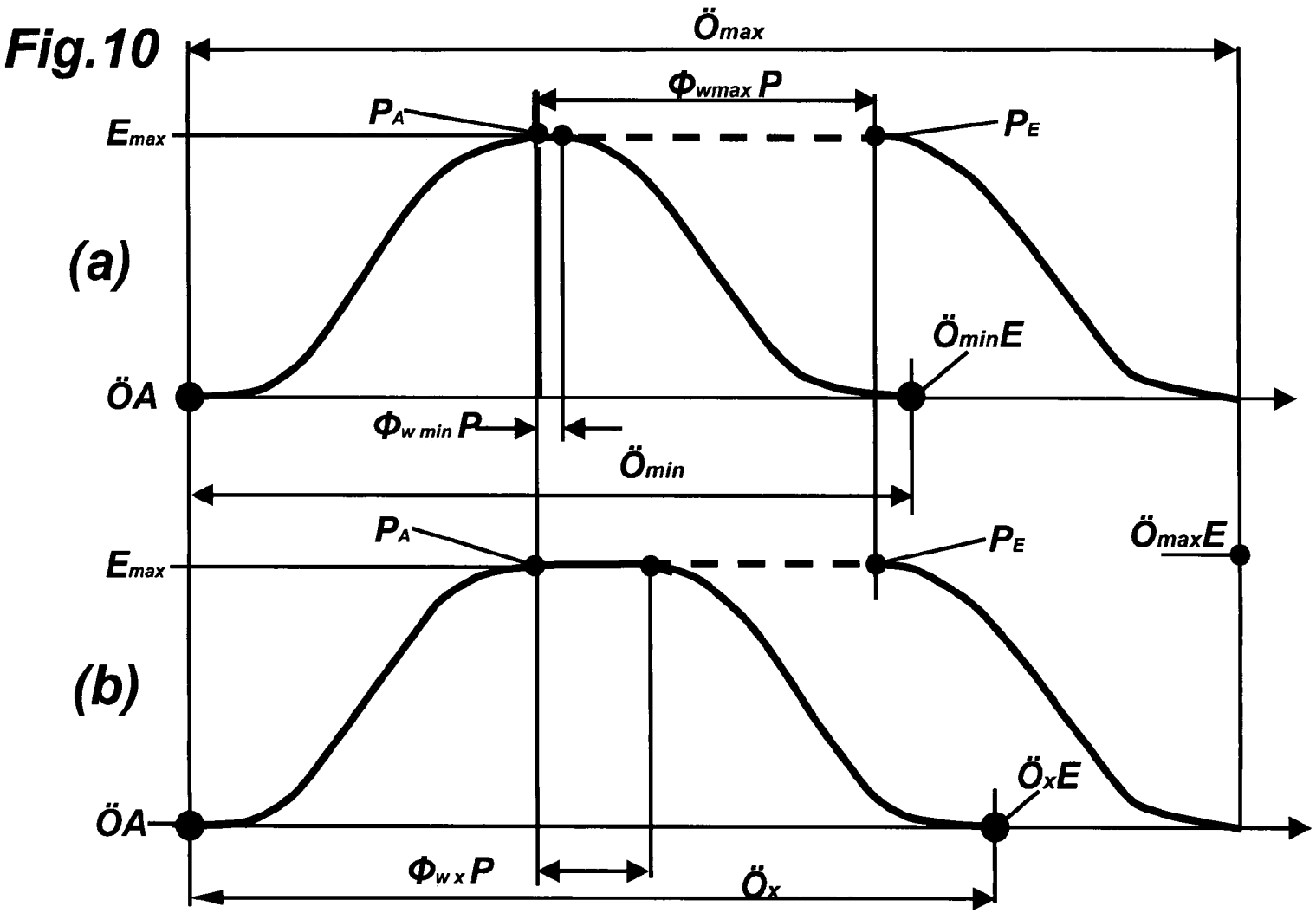
FIG. 10 shows the function of the valve gear according to the invention using a representation in the form of a diagram.

In FIG. 10, the function of the valve gear according to the invention is described using a representation in the form of a diagram.

In planes a and b of the lift diagram, the diagram for maximal valve opening time $O_{max}$ is shown, in each instance, with one of minimal valve opening time $O_{min}$ and with one for reduced valve opening time $O_x$, for comparison.

It can be seen that all of the settings of the valve opening times $O_{max}$, $O_{min}$, $O_x$ have a similar opening contour $O_A$–$P_A$ and closing contour $P_E$–$O_E$, as well as the maximal valve lift $E_{max}$, at all times.

The different duration of valve opening times is determined, in each instance, by the different angles $\Phi_{wmaxP}$; $\Phi_{wmin}P$; $O_{wx}P$ of the effectiveness of the plateau region P.

The angle $\Phi_{wmin}P$ of the effectiveness of the plateau region $P_A/P_E$ can never reach the value of zero, because the return time tr of roller 52 with roller axle 53 over the entire region of guide groove 50 cannot be infinitely short. This is due to the design and kinematics limitations of force F of spring 6, and to the mass inertia forces of roller 52 and roller axle 53, as well as the forces of rolling friction between roller 52 and cam 11 that must be overcome. Assuming that the return time tr of roller 52 when passing through plateau region P of cam 11 is constant at a position of control curve 42, in each instance, a proportion of the opening angle of valve 2 that is dependent on the speed of rotation occurs, in each instance. Therefore there is also a dependence on the speed of rotation of the entire opening angle of valve 2 at every position of control curve 42.

Figure 11:
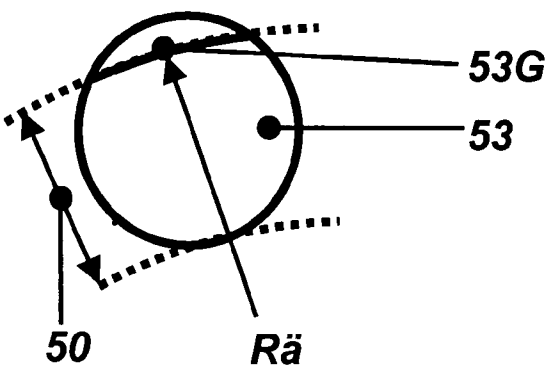
FIG. 11 shows the roller axle with a slide surface that is adapted to the guide groove in the form of a circular ring segment, in the intermediate element.

FIG. 11 shows roller axle 53 with a slide surface 53G, which is adapted to the outer radius $R_o$ of the guide track 50 in the shape of a circular ring segment in intermediate element 5. This embodiment takes the forces to be transferred for opening one or more valves 2 into account.

Accordingly, while only a few embodiments of the present invention have been shown and described, it is obvious that many changes and modifications may be made thereunto without departing from the spirit and scope of the invention.

REFERENCE SYMBOL LIST

1 camshaft
11 cam (inlet cam)
12 guide cylinder
2 load change valve (inlet valve)
3 rocker arm
30 axle for the mounting of 30 in the cylinder head
31 articulation axle for intermediate element 5
4 guide element, able to pivot, changeable in its position
41 axis of 4
42 control curve
5 intermediate element
5*a*/5*b* guide supports
50 guide groove for 53
50E right end contour of 53
51 parallel guide
52 roller
53 roller axle
6 wound bending spring
$B_{max}$ maximal displacement of 51 relative to the camshaft 1 at $E_{max}$
D53 outside diameter of 53
G53 slide surface of the roller axle 53
D12 diameter of the guide cylinder 12
DR direction of rotation of the camshaft 1 and the cam 11, respectively
E displacement of 2
G closed position of 2
F force of 6 that engages on 5 and forces 5 against 4 with force fit or holds it in engagement with force fit, respectively
$E_{max}$ maximal valve lift
$O_{max}$ opening with max. time cross-section
$O_{min}$ opening with min. time cross-section
$O_x$ reduced valve opening time
O open position of 2
P plateau region on 11
$P_A$ start of the plateau region
$P_E$ end of the plateau region
$R_o$ outer radius of 50 with center point camshaft axis
$R_i$ inner radius of 50 with center point camshaft axis
tr return time
ZK cylinder head
an=a0 to a5 various rotation positions of 1, proceeding from a0
ΦP extension angle of the plateau region P between $P_A/P_E$
$\Phi_{wmax}P$; $\Phi_{wmin}P$; $\Phi_{wx}P$ various angles of the effectiveness of the plateau region P as a function of the position of 42
e path to the stroke end
plane b lower plane FIG. 10
plane a upper plane FIG. 10
$O_A$ start of the opening contour of the cam
$O_E$ end of the opening contour of the cam

What is claimed is:

1. A valve gear arrangement for load change valves of internal combustion engines, the valves being held in the closed position by means of spring force, comprising:

a cylinder head;

an intermediate element articulated onto a rocker arm or pivot lever mounted in a fixed position in the cylinder head, so as to pivot, in order to activate the load change valves, said intermediate element resting against an adjustable counter-bearing;

a cam having a camshaft mounted in the cylinder head and being connected to the intermediate element such that said intermediate element transfers a stroke of the cam in changeable manner, for opening a load change channel in accordance with a cycle of the valve, wherein the cam has a plateau region (P) for maximal valve lift that follows a lift phase, wherein:

the intermediate element has a fork-shaped parallel guide that engages a guide cylinder of the camshaft, the guide cylinder having a center axis with a guide groove in the shape of a circular ring segment, in which groove a roller axle of a roller that engages the cam is moveably guided;

radially inner and radially outer delimitations of the guide groove describe arcs or curves that approximate the ring shaped groove, said arcs being configured centrally or with a slight deviation from a centered progression of the groove, relative to a plateau region (P), when the roller engages on the plateau region (P) of the cam;

in a position of the intermediate element when there is maximal lift ($E_{max}$) of the valve, the guide groove extends, starting from a plane of engagement of the roller on the cam, over the plateau region (P), opposite a direction of rotation (DR) of the camshaft;

springs are supported on the roller axle of the roller that engages the cam, said springs forcing the roller axle against a control curve of a guide element that is directed in the direction of rotation (DR) of the cam, counter to acting forces, when said guide element passes through the plateau region (P), and lies against said plateau region; and the control curve substantially covers the guide groove, proceeding from a plane of lifting of the roller by the cam, depending on its position.

2. A valve gear arrangement according to claim 1, wherein the axis of the camshaft is disposed below the rocker arm between an axle of the rocker arm and an articulation axle.

3. A valve gear arrangement according to claim 1, wherein the guide element is adjustable and pivots about an axle that is fixed in position.

4. A valve gear arrangement according to claim 1, wherein the roller axle has slide surfaces that are adapted to a shape of the guide groove.

* * * * *